US005503209A

United States Patent [19]

Healzer et al.

[11] Patent Number: 5,503,209

[45] Date of Patent: Apr. 2, 1996

[54] WINDOW VALANCE KIT

[75] Inventors: Janelle Healzer, Nixa; Jerry Stewart, Highlandville; Les Peck; Tony Sorci, both of Springfield, all of Mo.

[73] Assignee: Repcon International, Inc., Nixa, Mo.

[21] Appl. No.: 239,538

[22] Filed: May 9, 1994

[51] Int. Cl.[6] ..... E04F 10/00

[52] U.S. Cl. ..... 160/38

[58] Field of Search ..... 160/38, 39, 19, 160/405, 330

[56] References Cited

U.S. PATENT DOCUMENTS

| | | | |
|---|---|---|---|
| 2,243,222 | 5/1941 | Rebholz | 160/38 |
| 2,315,033 | 3/1943 | Adair | 160/39 |
| 2,375,247 | 5/1945 | Rebholz | 160/38 X |
| 2,415,330 | 2/1947 | Bashwiner | 160/38 |
| 2,448,061 | 8/1948 | Stenz | 160/39 |
| 2,539,380 | 1/1951 | Ziemmerman | 160/39 |
| 2,602,500 | 7/1952 | Slavin et al. | 160/38 |
| 2,637,380 | 5/1953 | Hyde | 160/38 |
| 2,862,549 | 12/1958 | Robbins | 160/38 |

*Primary Examiner*—David M. Purol

*Attorney, Agent, or Firm*—Hovey, Williams, Timmons & Collins

[57] ABSTRACT

A window valance kit assembled from paperboard stock configured for attaching a decorative material thereto to decorate a window. The window valance kit includes a valance body, decorative coverings and attachment tabs. The valance body is preferably constructed of a lightweight corrugated paperboard stock and includes multiple panels hingedly connected by fold lines. The multiple panels are folded along the fold lines to form the valance body. Decorative window coverings such as fabric, wallpaper, paint or lace are applied to the valance body to provide decoration, and the decorated valance is secured to a window or wall by paperboard securement tabs.

13 Claims, 3 Drawing Sheets

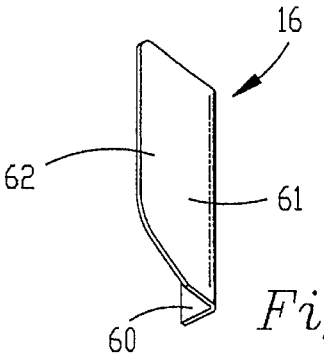
Fig. 9.
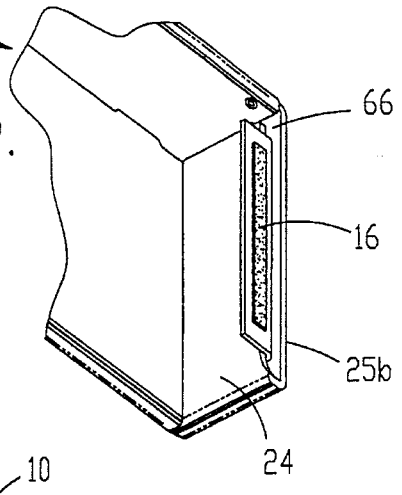
Fig. 10.
Fig. 1.
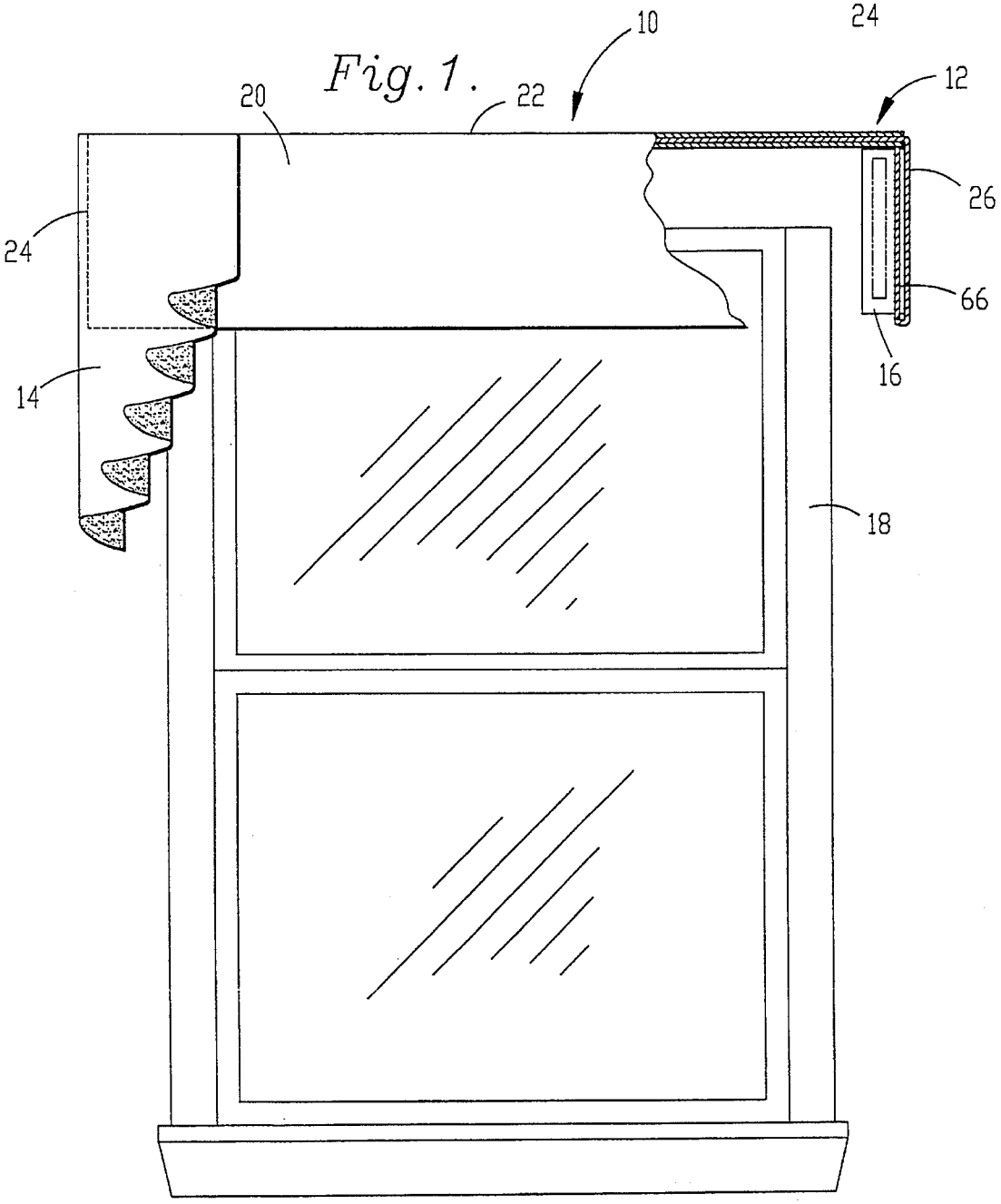

64
66
24
23
21
64
26

12
13
100a
27b
100b
100c
100d
100e
26
27a
20
21
22
101a
101b
101c
101d
101e
25b
24
12
25a 13
25b
100a
100b
100c
100d
100e
44
52
20
34
40
24
26
50
30
38
28
32
4a
64
64
36
22
64
27a
101a
101b
101c
101d
101e
25a

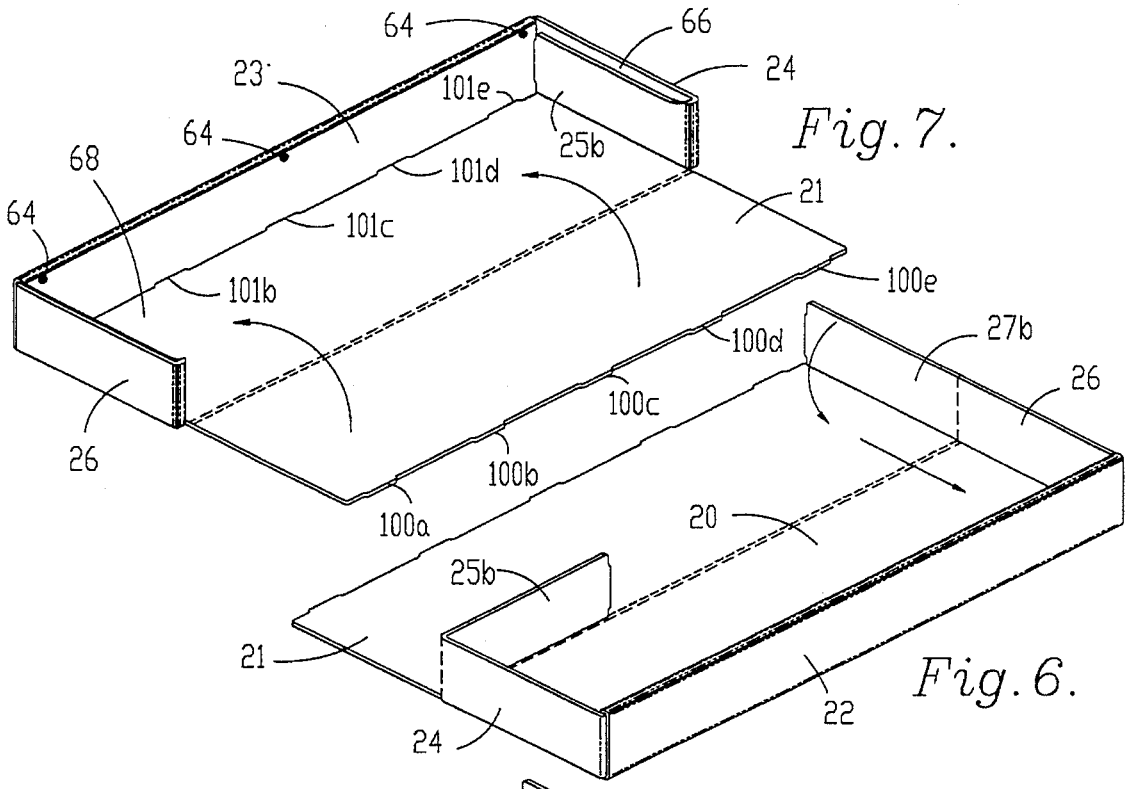
Fig. 7.
Fig. 6.
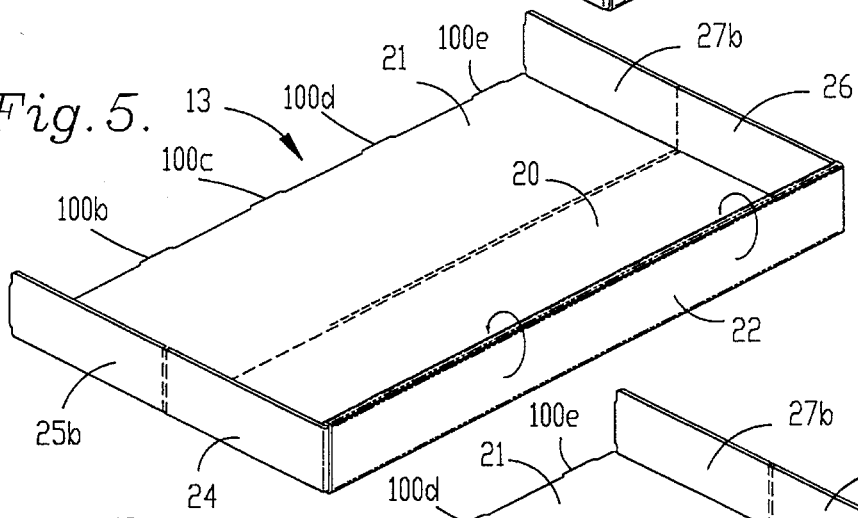
Fig. 5.
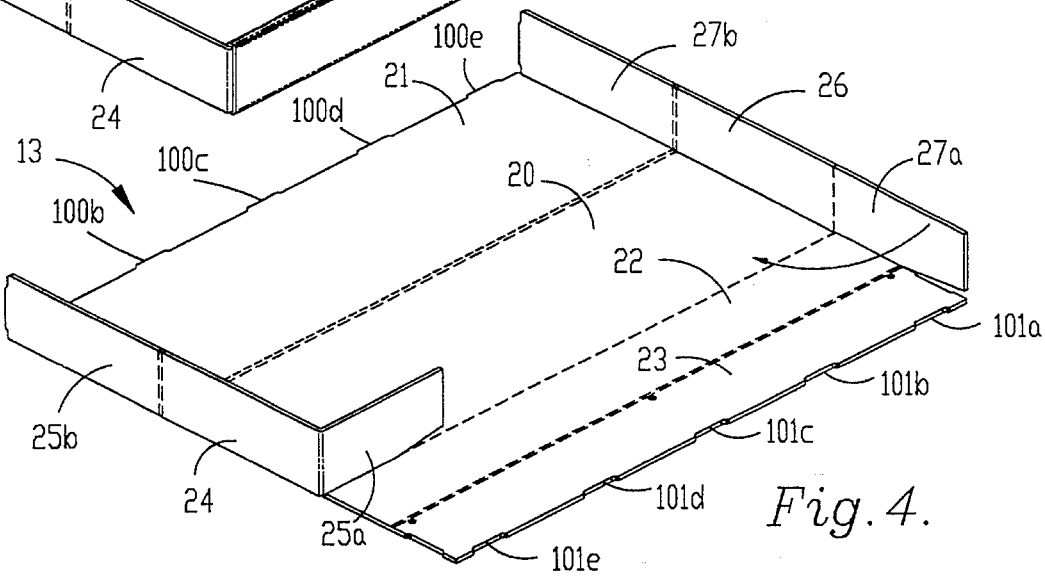
Fig. 4.

WINDOW VALANCE KIT

BACKGROUND OF THE INVENTION

1. Field of the Invention

The present invention is related to decorative window coverings. More particularly, the invention is related to a window valance kit preferably assembled from paperboard stock configured for attaching a decorative material thereto to decorate a window.

2. Description of the Prior Art

A window valance is a decorative item used for decorating windows. A typical valance includes a rectangular-shaped frame or box decorated with fabric, lace or ribbons. Window valances are used both to hide unsightly curtain rods or window blind housings and to provide a decorative touch to the top of a window by adding depth to the window.

Prior art window valances include both premanufactured standard sized valances and custom-made valances. Both types of prior art valances include a valance body usually made out of light wood and decorative coverings such as material or fabric sewn on the body for decoration. The decorated valance bodies are then attached to a window or a wall above a window.

These prior art window valances suffer from several drawbacks which limit their utility. For example, custom-made valances must be specially fitted for a particular window and require decorative materials which are permanently sewn on the valance body. Although these custom-made valances offer many decorating options, they are expensive and difficult to make and install.

Pre-manufactured, standard sized valances also have drawbacks. Although these prior art valances are cheaper than custom made valances, they do not allow the designer to custom-decorate to meet a particular design need. These standardized valances are sold with covering material pre-applied and offer only a few design and color choices. Moreover, both custom-made and standardized window valances are formed with heavy wood or metal frames. The excessive weight of these prior art valances makes them more expensive, harder to transport, and difficult to attach to a window or wall.

Thus, a need exists for a window valance which allows a designer to design a window covering with numerous decorating options. A need also exists for a valance which may be custom-decorated, yet inexpensive and easy to assemble. A need also exists for a window valance which is lightweight and easy to attach to a window or wall surrounding a window. A further need exists for a window valance which is pre-cut for assembly without tools and is readily and economically transportable.

OBJECTS AND SUMMARY OF THE INVENTION

It is an object of the present invention to provide a window valance which can be decorated in numerous ways to suit the tastes of a particular designer.

It is also an object of the invention to provide a custom-designed window valance which is inexpensive and easy to assemble.

It is still another object of the invention to provide a window valance which is lightweight and easy to attach to a window or wall surrounding a window.

It is another object to provide a window valance which is pre-cut providing easy assembly and mounting and which may be compactly and economically stored and transported.

In accordance with these and other objects evident from the following description of the invention, a window valance kit is provided for use in creating a custom-designed window decoration for attachment to a window. The preferred window valance kit includes a valance body and attachment structure for attaching the valance body to a window.

The valance body is preferably constructed of a lightweight corrugated paperboard stock and is therefore easy to transport, assemble, decorate and hang. The preferred valance body includes multiple panels hingedly connected by fold lines. The panels are initially stored in a flat-position and are folded along the fold lines to form the valance body.

Decorative window coverings such as fabric, wallpaper, paint or lace are applied to the valance body to provide decoration. Since the valance body is constructed of paperboard material rather than wood or metal, decorative coverings can be easily secured by adhesive, tacks or other conventional attachment device.

The window valance kit includes securement means for securing the valance to a wall or window. The preferred window valance kit includes a plurality of multi-panel tabs which are first secured to a window or wall by using adhesive tape, hook and loop fasteners, or hardware such as nails or anchor bolts, and which then couple with the valance body for securing the window valance to the wall.

The present invention provides numerous advantages over the prior art. For example, unlike standardized pre-assembled window valances, the present window valance kit allows the designer to select the type of decorations to be attached. This is especially advantageous for those decorators wishing to avoid the usually necessary carpentry and concentrate on the particular decorating treatment. Thus, the window valance can be decorated in numerous ways to suit the tastes of a particular interior designer or homemaker.

Another advantage of the present invention is that, unlike prior art custom-built valances, it provides a custom-designed window decoration which is inexpensive and easy to assemble. Since the valance body is manufacture from lightweight paperboard, it can be mass-produced and shipped inexpensively. A further advantage of the invention is that it provides a window valance body which is lightweight and therefore easy to attach to a window or wall.

BRIEF DESCRIPTION OF THE DRAWINGS

FIG. 1 is a pictorial view of an assembled and decorated window valance kit in accordance with the present invention shown secured to a typical window;

FIG. 4 is bottom view of a partially assembled window valance body showing a first assembly step;

FIG. 5 is bottom view of a partially assembled window valance body showing a second assembly step;

FIG. 6 is bottom view of a partially assembled window valance body showing a third assembly step;

FIG. 7 is bottom view of a partially assembled window valance body showing a fourth assembly step;

FIG. 9 is an isometric view of the attachment tab for securing the valance body to a window; and FIG. 10 is a partial isometric view of an attachment tab coupled with a valance body.

DETAILED DESCRIPTION OF THE PREFERRED EMBODIMENTS

Figures 2, 3, 8:
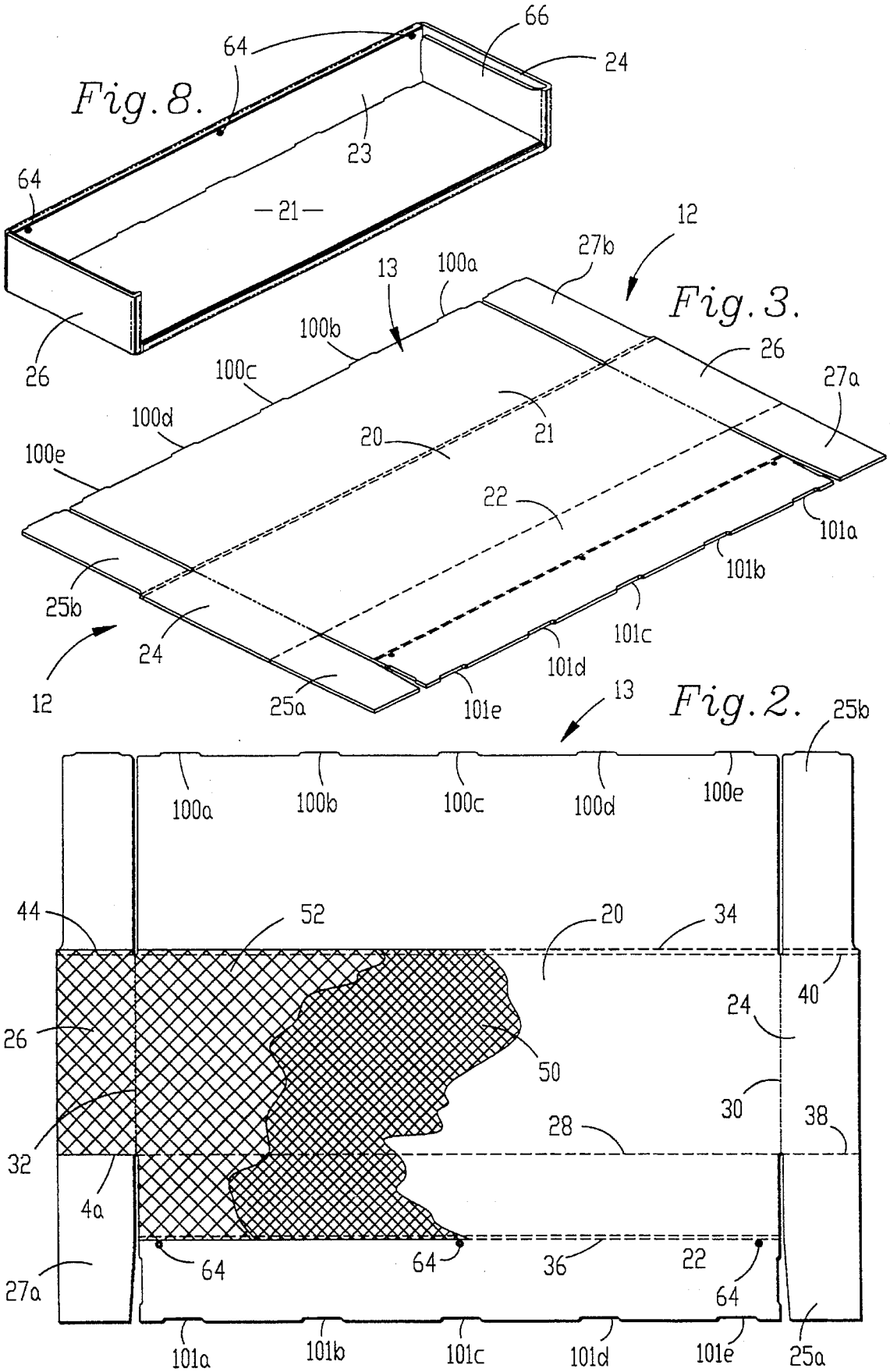
FIG. 2 is a top view of an unassembled window valance body showing the partial attachment of a decorative covering material.
FIG. 3 is a bottom view of an unassembled window valance body.
FIG. 8 is bottom view of a fully assembled window valance body.

Turning now to the drawings, and particularly FIG. 1, the preferred window valance kit 10 broadly includes window valance body 12, covering material 14, and attachment structure 16. As illustrated, the preferred window valance kit 10 is designed to provide a decorative covering which is mounted on the wall near the top of a typical window 18.

Window valance body 12 forms the body of the window valance and provides structural support for decorative covering material 14. As best illustrated in FIGS. 2 and 3, the preferred window valance body 12 is assembled from a paperboard blank 13 formed of lightweight corrugated paperboard stock material such as cardboard. By manufacturing the window valance body with paperboard, a lightweight window covering is provided which is inexpensive, easy to ship, and easy to assemble. Paperboard blank 13 lays flat until assembled and thus requires little storage space.

Referring to FIG. 2, valance body 12 broadly includes front panel 20, top panel 22, left side panel 24 and right side panel 26. Panels 20, 22, 24, and 26 are hingedly connected by fold lines 28, 30 and 32. In the preferred embodiment of the present invention, fold lines 28, 30, and 32 are preferably defined by perforating or scoring paperboard blank 13 at the selected locations. As described in more detail below, valance body 12 is assembled by folding panels 20, 22, 24, and 26 inwardly along fold lines 28, 30, and 32, respectively.

In more detail, front panel 20 includes bottom end flap 21 hingedly connected by fold line 34. Bottom end flap 21 includes a plurality of notches 100*a*, 100*b*, 100*c*, 100*d* and 100*e* formed in the outer edge 70 thereof. The function of these notches is described in detail below. Top panel 22 includes top end flap 23 hingedly connected by fold line 36. Top end flap 23 includes a plurality of grooves 101*a*, 101*b*, 101*c*, 101*d*, and 101*e* formed on the outer margin 72 thereof for receiving notches 100*a–e* of bottom end flap 21 as described below.

Left side panel 24 includes top and bottom end flaps 25*a* and 25*b* hingedly connected by fold lines 38 and 40, respectively. Right side panel 26 includes top and bottom end flaps 27*a* and 27*b* hingedly connected by fold lines 42 and 44, respectively.

FIGS. 4–8 illustrate the preferred method of assembly of a window valance body 12 from paperboard blank 13. As illustrated in FIG. 4, blank 13 is initially laid flat with the undercoated side facing up. Left and right side panels 24 and 26 are folded in first, and left and right side top end flaps 25*a* and 27*a* are folded in second. As illustrated in FIG. 5, top panel 22 is folded third to overlie left and right side top end flaps 25*a* and 27*a*, and top end flap 23 is folded fourth to surround left and right side top panels 25*a* and 27*a*.

As illustrated in FIGS. 6 and 7, left and right side bottom end flaps 25*b* and 27*b* are folded fifth to overlie left and right side panels 24 and 26, respectively. After this folding step, a gap 66 is formed between left side panel 24 and left side panel bottom end flap 25*b*. A similar gap 68 is formed between right side panel 26 and right side panel bottom end flap 27*b*. Gaps 66 and 68 are configured for receiving securement tabs 16 as described in detail below.

FIG. 7 illustrates the final folding step, where front panel bottom end flap 21 is folded to overlie front panel 20 to complete valance body 12. To lock bottom end flap 21 into top end flap 23, notches 100*a*–100*e* are inserted into grooves 100*a–e* respectively. In this way, the plurality of panels are locked together, forming a rigid valance body 12. As those skilled in the art will appreciate, the order of the folding steps recited above may be altered somewhat without affecting the final design of valance body 12.

FIGS. 1 and 2 illustrate the decoration of valance body 12. Since valance body 12 is formed of paperboard material, various coverings can be easily attached to create a custom-designed window decoration. In the preferred embodiment, an adhesive coating 50 such as fusing tape made by Singer Sewing Co. of Edison, N.J., or glue or tape is applied to the portions of the valance body desired to be decorated. As illustrated in FIG. 2, a covering material 52 such as fabric material, decorative paper, ribbons or lace is then adhered to adhesive coating 50 to decorate valance body 12. As those skilled in the art will appreciate, assembled valance body 12 can be decorated either before or after folding.

FIGS. 1, 9 and 10 illustrate the securement tabs 16 for securing a decorated valance body 12 to window 18 or a surrounding wall. In the preferred embodiment, two securement tabs are provided, one for each side of valance body 12.

Securement tabs 16 are formed of paperboard material and include first panel 60 and second panel 62 hingedly connected by fold line 61. First panel 60 is secured to a window 18 or surrounding wall by two-sided tape, screws or other conventional attachment devices. Second panel 62 is then folded along fold line 61 to form a 90 degree angle with respect to first panel 60. Second panel 62 is then inserted in the gap 66 between left side panel 24 and left side panel bottom end flap 25*b*. The weight of the window valance is thus transferred to the wall via securement tab 16 second panel 62.

A second securement tab is attached to the right side of valance body 12 in the same manner as described above. As illustrated in FIG. 1, a pair of securement tabs 16 secure a decorated valance body 12 to the wall above window 18.

FIG. 8 illustrates an alternate securement structure for securing valance body 12 to window 18. For quick mounting, top panel 22 of valance body 12 may include a plurality of metal grommets 64 enclosing a plurality of holes punched in top panel 22. Grommets 64 are configured for receiving the ends of a plurality of hooks attached to the wall. To secure the decorated window valance above window 18, the grommets are simply placed over the ends of the wall-mounted hooks.

In use, window valance kit 10 provides a custom-designed window decoration which is easily attached to a window 18. Since the valance body is constructed of a lightweight paperboard stock, it is inexpensive and easy to assemble, decorate and hang. In particular, the valance body may be hung by using adhesive tape, hock and loop fabric such as that sold under the trademark VELCRO, nails, anchor bolts or screws connecting the tabs to the wall. To create a custom-designed window covering, the designer merely has to fold the valance body, attach decorative coverings such as fabric, wallpaper, paint or lace, and secure the valance body to a window using the attachment tabs or grommets described above.

The above-described window valance kit provides numerous advantages. For example, the present window valance kit allows the designer to select the type of decorations to be attached; therefore, the window variance can be decorated in numerous ways to suit the tastes of a particular designer.

Another advantage is that it provides a custom-designed window decoration which is inexpensive and easy to assemble. Paperboard blank 13 lays flat until assembled to form valance body 12, and is thus easy to transport and store. Unlike pre-manufactured window valances, a retailer can stock thousands of the window valance kits in a small storage area.

A further advantage of the above-described invention is that it provides a window valance body which is lightweight and therefore easy to attach to a window or wall.

As those skilled in the art will appreciate, the present invention encompasses many variations in the preferred embodiments described above. For example, the valance body may include numerous variations in the panel structure and folding sequence. Additionally, many conventional attachment devices may be utilized to secure the valance body to a window.

Having thus described the preferred embodiments of the invention, the following is claimed as being new and desired to be secured by Letters Patent:

1. A valance kit comprising, in combination:

a unitary valance body presenting a front panel, a top panel hingedly connected thereto by a top fold line, a bottom end flap hingedly connected to said front panel along a bottom fold line oriented substantially parallel to said top fold line, said bottom end flap including an outer edge spaced from said top fold line presenting at least one notch therein, and a top end flap hingedly connected to said top panel along a top flap fold line oriented substantially parallel to said top fold line, said top end flap presenting an outer margin spaced from and opposed to said top flap fold line and including at least one groove therein, said bottom end flap being folded along said bottom fold line into substantially parallel orientation with said front panel wherein said outer edge is adjacent said top fold said top panel being folded along said top fold line into an angled orientation relative to said front panel, said top end flap being folded along said top flap fold line into an angled orientation relative to said front panel with said outer margin located adjacent to said outer edge with said at least one groove receiving said at least one notch in interlocking relationship therein to present a self-sustaining valence body; and means for securing said valence body to a supporting structure.

2. A valence kit as set forth in claim 1, including first and second side panels hingedly connected to said front panel along spaced apart respective first and second side fold lines oriented at an angle to said top fold line, said first and second side panels being folded along said respective first and second side fold lines into an angled orientation relative to said front panel.

3. A valence kit as set forth in claim 2, including first and second top side end flaps respectively hingedly connected to said first and second side panels along respective top side end flap fold lines oriented substantially parallel to said top fold line, said top side end flaps being folded along said top side end flap fold lines and positioned between said top panel and said top end flap.

4. A valence kit as set forth in claim 2, including first and second bottom side end flaps respectively hingedly connected to said first and second side panels along respective bottom side end flap fold lines oriented substantially parallel to said top fold line, said bottom side end flaps being folded along said bottom side end flap fold lines into substantially parallel orientation to said side panels.

5. A valence kit as set forth in claim 3, including first and second bottom side end flaps respectively hingedly connected to said first and second side panels along respective bottom side end flap fold lines oriented substantially parallel to said top fold line, said bottom side end flaps being folded along said bottom side end flap fold lines into substantially parallel orientation to said side panels.

6. A valence kit as set forth in claim 5, wherein said securing means includes a plurality of grommets each enclosing a hole in said valance body.

7. A valence kit as set forth in claim 5, wherein said securing means includes first and second tabs coupled with said valence body and inserted in a gap defined between each said side panel and its respective bottom end flap for supporting said valence body on said supporting structure.

8. A valence kit as set forth in claim 5, including a fabric covering over at least said front panel.

9. A valence kit as set forth in claim 5, wherein said valence body is constructed of corrugated cardboard.

10. A valence kit as set forth in claim 5, wherein said front panel is continuously connected to said top panel, bottom panel and side panels respectively along said top fold line, said bottom fold line and said side fold lines.

11. A paperboard blank for configuring into a valence, said blank comprising:

a front panel;

a top panel hingedly connected to said front panel along a top fold line;

a bottom end flap hingedly connected to said front panel along a bottom fold line oriented substantially parallel to said top fold line, said bottom end flap including an outer edge spaced from said top fold line presenting at least one notch therein;

a top end flap hingedly connected to said top panel along a top flap fold line oriented substantially parallel to said top fold line, said top end flap presenting an outer margin spaced from and opposed to said top flap fold line and including at least one groove therein; and first and second side panels hingedly connected to said front panel along respective first and second side fold lines oriented substantially normal to said top fold line.

12. A paperboard blank for configuring into a valence as set forth in claim 11, including top and bottom end flaps hingedly connected to each said first and second side panels along respective top and bottom flap fold lines, said top flap fold lines and said bottom flap fold lines being oriented substantially parallel to said top fold line.

13. A paperboard blank for configuring into a valence as set forth in claim 12, wherein said top flap fold lines are substantially aligned with said top fold line and said bottom flap fold lines are substantially aligned with said bottom fold line.

* * * * *